US006378864B1

(12) United States Patent
Iesaka

(10) Patent No.: US 6,378,864 B1
(45) Date of Patent: Apr. 30, 2002

(54) STACKER

(75) Inventor: Tsutomu Iesaka, Tokorozawa (JP)

(73) Assignee: Citizen Watch, Co., LTD, Tokyo (JP)

( * ) Notice: Subject to any disclaimer, the term of this patent is extended or adjusted under 35 U.S.C. 154(b) by 0 days.

(21) Appl. No.: 09/486,800

(22) PCT Filed: Feb. 17, 1999

(86) PCT No.: PCT/JP99/00694

§ 371 Date: Mar. 2, 2000

§ 102(e) Date: Mar. 2, 2000

(87) PCT Pub. No.: WO99/23367

PCT Pub. Date: Apr. 27, 2000

(30) Foreign Application Priority Data

Oct. 20, 1998 (JP) ..... 10-297868
Oct. 27, 1998 (JP) ..... 10-300607

(51) Int. Cl.[7] ..... B65H 5/34; B65H 29/66
(52) U.S. Cl. ..... 271/270; 271/202
(58) Field of Search ..... 271/270, 202; 399/396, 8–23, 107–126, 361–407; 270/52.01–58.34

(56) References Cited

U.S. PATENT DOCUMENTS 4,974,828 A * 12/1990 Matsuo et al. ..... 271/293 X
5,609,335 A * 3/1997 Parker ..... 271/302 X
5,941,518 A * 8/1999 Sokac et al. ..... 271/10.05 X
5,984,299 A * 11/1999 Hirota et al. ..... 271/161 X

FOREIGN PATENT DOCUMENTS

JP 57-27272 2/1982
JP 4-237075 8/1992
JP 10-226447 8/1998

* cited by examiner

*Primary Examiner*—David H. Bollinger
*Assistant Examiner*—Kenneth W. Bower
(74) *Attorney, Agent, or Firm*—Finnegan, Henderson, Farabow, Garrett & Dunner, L.L.P.

(57) ABSTRACT

A stacker (10) includes a housing (18) provided with an inlet port (20) and an outlet port (22), a tray (14) arranged beneath the outlet port of the housing in an upward/downward movable manner, and a transfer mechanism for transferring printed sheets from the inlet port to the outlet port and discharging the sheets above the tray through the outlet port. The sheet transfer velocity of the transfer mechanism is controlled in three stages including an intake speed ($V_1$) at which the printed sheets are taken in through the inlet port, a carrying speed ($V_2$) at which the sheets are carried from the inlet port to the outlet port and a discharge speed ($V_3$) at which the sheets are discharged from the outlet port above the tray. The carrying speed is higher than the intake speed, and the discharge speed is not lower than the carrying speed. As a result, even when a concavely curled paper, taken in from the printer, is carried in a face-up state to be discharged above the tray, the paper can be prevented from leaning against the back plate of the housing, and thereby the problem of a loading failure of the papers during an automatic operation can be solved.

8 Claims, 12 Drawing Sheets

STACKER

DESCRIPTION

1. Technical Field

The present invention relates to a stacker for stacking and holding a multiplicity of printed printing papers delivered from a printer.

2. Background Art

A stacker adapted to be arranged adjacent to a paper delivery port of a printer, for sequentially taking in a multiplicity of printed printing papers (or sheets) delivered from the printer and for stacking and holding the papers thus taken in on a tray and in order, is known. In this type of stacker, in order to smoothly take in and carry a large number of papers delivered at a predetermined rate from the printer, a paper carrying speed in a stacker body is normally set at a paper intake speed (equal to the paper delivery speed of the printer) or higher. Especially, in order to shorten a time required for taking in the paper and stacking it on the tray, the conventional stacker has set the paper carrying speed at a sufficiently high level as compared with the paper intake speed.

Under this speed setting, when the stacker is used for a high-speed printer (referred to as, e.g., a high-speed page printer) capable of printing dozens of papers per minute, the paper carrying speed tends to reach a high level such as several hundreds of mm/s. The papers carried at high speed are discharged from an outlet port provided on the back side of the stacker to fly above the tray extending rearward of the stacker, and freely fall on the tray to be stacked one by one. The tray is usually provided with a paper support surface inclined in such a manner that the proximal end thereof adjacent to the stacker body is positioned lower than the distal end thereof. Thus, the paper that has first fallen on the tray slides downward on the support surface by its own weight, and bumps against a back plate of the stacker body to come to a stop at a predetermined position. The paper that has subsequently fallen on the tray slips downward on the first paper, and it also bumps against the back plate of the stacker body to come to a stop at a predetermined position. In this way, a multiplicity of papers are stacked with the edges thereof aligned with one another.

Incidentally, if a speed at which the paper is discharged from the outlet port is excessively high, the flying distance of the paper may be increased and thus the sliding distance on the tray may be increased. In this case, it is often difficult to stack a large number of papers in a mutually exact alignment on the tray. In view of this, in the conventional stacker adapted to be used for the high-speed printer, a paper discharge speed is set lower than a paper carrying speed, so as to prevent the excessive flying of the paper. FIG. 13 is a velocity diagram showing one example of a paper-transfer velocity change between the paper intake and the paper discharge in the conventional stacker used for the high-speed printer. In FIG. 13, a horizontal axis represents a time (ms) and a vertical axis represents the peripheral velocity (mm/s) of an eject roller installed at the outlet port of the stacker. The eject roller is one of drive rollers for transferring the papers delivered from the high speed printer inside the stacker body. The rotational speed of the eject roller is controlled by stages over a time period $T_1$ for taking the paper into the stacker body, a time period $T_2$ for carrying the paper in the stacker body and a time period $T_3$ for discharging the paper above the tray.

In the illustrated example, when the stacker receives a paper delivery signal from the high-speed printer, the eject roller first starts to rotate at a peripheral velocity of 180 mm/s identical to the paper delivery speed of the printer (the intake time $T_1$). The paper is transferred at this intake speed $v_1$ to the eject roller along a paper guide in the stacker body. When the paper arrives at a predetermined position at [t01], the eject roller increases the peripheral velocity to 750 mm/s, and catches the paper to transfer it to the outlet port at this carrying speed $v_2$ (the carrying time $T_2$). When the leading portion of the paper protrudes from the outlet port by a predetermined length at [t02], the eject roller decreases the peripheral velocity to 400 mm/s, and acts to discharge the paper from the outlet port at this discharge speed $V_3$ above the tray to make it fly thereabove (the discharge time $T_3$). After that, at [t03], the eject roller is returned to the intake speed $V_1$ and waits for the next paper.

Also for the next paper, the peripheral velocity of the eject roller is controlled in the same way, i.e., to the intake speed $v_1$=180 mm/s from t03 to t11, to the carrying speed $v_2$=750 mm/s from t11 to t12, and to the discharge speed $V_3$=400 mm/s from t12 to t13. Subsequently, the printed papers are discharged successively from the printer at the speed of, e.g., 42 sheets per minute (the cycle of 1430 ms). Thus, the eject roller changes the peripheral velocity thereof by stages in the same way, and repeats the intake, carry and discharge of the paper, so as to stack a large number of papers on the tray.

The above-described stacker for the high-speed printer is required to be able to automatically and accurately stack and hold several thousand papers on the tray, so as to cope with the automatic operation of the printer. For this purpose, this type of stacker generally incorporates therein an automatic lift mechanism of the tray. The automatic lift mechanism includes a paper stack sensor of a reflection type arranged at a predetermined position on a back plate below the outlet port of a stacker back-side, and a tray drive mechanism activated in accordance with a sensing signal of the paper stack sensor. When a paper stack piled on the tray closes the front side of the paper stack sensor, the paper stack sensor outputs the sensing signal, and thereby the tray drive mechanism is activated to move the tray downward. Consequently, the position of the top surface of the paper stack on the tray is held at a substantially constant height in the vicinity of the paper stack sensor. When the tray moves downward in accordance with the increase in the number of stacked papers and reaches a lowest position with several thousand (e.g., three thousand or more) papers being piled thereon, a limiter placed at the lowest position of the tray detects the tray and outputs a stop signal to the control section of the printer and stacker. As a result, the printer and stacker come to a stop, and thereby a printing and paper stacking operation is completed.

In the conventional stacker having the above configuration, a circumstance may arise wherein a paper, expected to fly and fall toward the tray, falls, contrary to expectations, along the back plate of the stacker body while coming into partially contact therewith. In this case, the paper cannot be laid in flat on the tray or on the previously formed paper stack, but tends to lean at a part thereof against the back plate of the stacker body.

One of the factors of this falling behavior of the paper is an adsorbing action due to static electricity charged on the paper in the printer. If the paper is considerably charged, the paper cannot sufficiently fly after it is discharged from the outlet port of the stacker, but is adsorbed to the back plate of the stacker due to an electrostatic absorbing force. Therefore, in order to eliminate the static electricity charged on the paper, the conventional stacker is constituted such that a charge-eliminating brush is placed around the outlet port and the paper is discharged above the tray from the outlet port after any charge is eliminated by coming into contact with the charge-eliminating brush. The charge-eliminating brush can exhibit a charge-eliminating effect to some degree by optimizing the dimensions and location thereof, but is difficult to perform perfect charge-elimination, and thereby the paper is actually discharged with the static electricity of 1 kV to 2 kV remaining on the paper. An effective method for completely eliminating the static electricity of the paper is in using a voltage-impress type charge-eliminator to generate ions through a corona discharge and to neutralize the charge of a charged object by the ions. However, this method is generally expensive and is thus difficult to employ.

FIG. 14 is an enlarged view of a part of a conventional stacker around an eject roller, for illustrating the leaning phenomenon of a printing paper. A top paper 3 of a paper stack 2 piled on a tray 1 is placed in such a manner as to lean at an edge portion thereof against a back plate 4 of a stacker body. In this state, if the leaning portion of the paper 3 closes the front side of a reflection-type paper stack sensor 5, the paper stack sensor 5 outputs a sensing signal and thereby the tray 1 moves downward in spite of the fact that printing papers are not stacked to a predetermined height. In the case where the paper 3 is adsorbed to the back plate 4 and keeps on closing the front side of the paper stack sensor 5 even after the tray 1 moves downward, the tray 1 continues to fall and finally arrives at a most lowered position. Then, a limit switch (not shown) is turned on and the printer and the stacker come to a stop, despite the fact that the paper stack has not reached a predetermined amount, which results in a loading failure.

It has been found that the paper 3 is liable to lean against the back plate due to electrostatic absorption, especially in the case where the end portion of an eject roller guide 7 arranged around an eject roller 6 of the stacker is exposed as a part of the back plate 4 of the stacker body, as shown in FIG. 14. In this case, the exposed portion of the eject roller guide 7 also acts as the exterior part of the stacker body and, therefore, the eject roller guide 7 is formed from a surface-treated steel plate having a very-thin oxide film with a thickness on the order of $\mu$m. As a result, when the charged paper 3 comes into contact with the eject roller guide 7, the charge of opposite polarity to the paper 3 is induced in the contacted portion of the surface-treated steel plate, and the induced charge is difficult to discharge due to the oxide film, which results in the condition where the paper 3 is liable to be adsorbed electrostatically.

Another factor in the leaning phenomenon of the paper against the back plate of the stacker body is the fact that the paper delivered from the stacker has a curled configuration. The paper printed in a high-speed printer is normally delivered through a process of fixing a toner on a paper surface by heat, and therefore is generally deformed and curls after it is delivered. This deformation makes the outer edge of the paper rise upward when the paper is placed on a flat surface with the printed side thereof facing upward, and this is referred to as a concave-curl in this specification. Every paper delivered from the printer is taken into the stacker, while exhibiting a concave-curl shape, in a face-up state where the printed side of the paper faces upward.

In the case where the stacker carries the paper taken-in from the printer and discharges it above the tray in the face-up state, the paper gains the concave-curl shape as it is fed out from the outlet port, and thereby the leading end portion of the paper is raised. Especially in the case where the carrying speed of the eject roller is high, the leading end portion of the paper is further curled upward due to a lifting force. As a result, the instant that the rear end of the paper leaves the eject roller and the paper is released from the discharge force of the eject roller, the paper stalls and falls down without flying. In this situation, if the residual charge remains on the paper, the paper is adsorbed onto and leans against the back plate.

A more detailed explanation will be given with reference to FIG. 13. The time period concerned with the flying behavior of the paper consists of the carry time $T_2$ (ti1 to ti2; i=1 to 3000) and the discharge time $T_3$ (ti2 to ti3; i=1 to 3000), and particularly the carrying speed $V_2$ for the carry time $T_2$ significantly affects the flying mode of the paper. This is because the paper transfer mechanism of the stacker is so constructed that a major part of the paper (e.g., five-sixths of a A4-sized paper measured along a feeding direction) is fed out above the tray from the outlet port during the carry time $T_2$ and the remaining part (one-sixth of the A4-sized paper measured along the feeding direction) is carried and discharged during the discharge time $T_3$.

It is generally difficult for the stacker to correct therein the concave curl of the paper provided in a printing process. In order to correct the concave curl, it is advantageous that a curl-eliminating unit (a decurler) is installed between the printer and the stacker to eliminate the curl of the paper delivered from the printer before it is taken into the stacker. However, the decurler is generally expensive and requires adjustment according to the degree of the curl and, therefore, it is difficult to employ.

On the other hand, a stacker having the function of inverting the paper during a carrying stage is known. This stacker can turn the paper taken-in from the printer upside-down in the carrying stage and can discharge the paper above the tray in a face-down state where the printed side of the paper faces downward. In this case, when the paper has gained the concave-curl shape as it is fed out from the outlet port, the leading end of the paper drops down toward the tray, so that, even in the case of a high carrying speed, the paper can sufficiently fly without being inconveniently affected by a lifting force, whereby the problem of paper leaning against the back plate does not always occur. However, a carrying mode including paper inversion requires a longer time than a normal face-up carrying mode, and therefore, even a stacker having a paper inverting function is generally so constructed that the face-up carrying mode can be optionally selected.

DISCLOSURE OF THE INVENTION

The object of the present invention is to provide a stacker which, even when a paper having a concave-curl shape taken-in from a printer is carried and discharged in a face-up state above a tray, can prevent the paper from leaning against a back plate of a stacker body and can solve the problem of a possible loading failure of papers during an automatic operation.

In order to accomplish the above object, the present invention provides a stacker comprising a housing provided with an inlet port and an outlet port; a tray arranged beneath the outlet port of the housing in an upward/downward movable manner; a transfer mechanism for transferring printed sheets from the inlet port to the outlet port and discharging the sheets above the tray through the outlet port; and a control mechanism for controlling a sheet transfer velocity of the transfer mechanism in three stages including an intake speed at which the printed sheets are taken in through the inlet port, a carrying speed at which the sheets are carried from the inlet port to the outlet port and a discharge speed at which the sheets are discharged from the outlet port above the tray, wherein the carrying speed is higher than the intake speed and the discharge speed is not lower than the carrying speed.

In a preferred embodiment, the carrying speed is not more than 500 mm/s.

Also, in a preferred embodiment, the discharge speed is not more than 500 mm/s.

It is preferred that the transfer mechanism includes a pickup roller arranged at the inlet port, a first drive source for the pickup roller, an eject roller arranged at the outlet port and a second drive source for the eject roller, and that the control mechanism controls the second drive source in three stages of the intake speed, the carrying speed and the discharge speed.

The tray may be provided with an inclined support surface of which a proximal end, nearer to the housing, is positioned lower than a distal end.

The stacker may further comprise an automatic lift mechanism for moving the tray downward as the number of printed sheets stacked on the tray increases.

Also, the stacker may further comprise an insulating member arranged on a part of a lateral support surface of the housing located below the outlet port.

In this arrangement, it is advantageous that the insulating member is formed from a thin plate secured to the lateral support surface.

The present invention further provides a stacker comprising a housing provided with an inlet port and an outlet port; a tray arranged beneath the outlet port of the housing in an upward/downward movable manner; a transfer mechanism for transferring printed sheets from the inlet port to the outlet port and discharging the sheets above the tray through the outlet port; and an insulating member arranged on a part of a lateral support surface of the housing located below the outlet port.

BRIEF DESCRIPTION OF THE DRAWINGS

The above and other objects, features and advantages of the present invention will be described in connection with the embodiments shown in the accompanying drawings, in which.

BEST MODE FOR CARRYING OUT THE INVENTION

Figure 1:
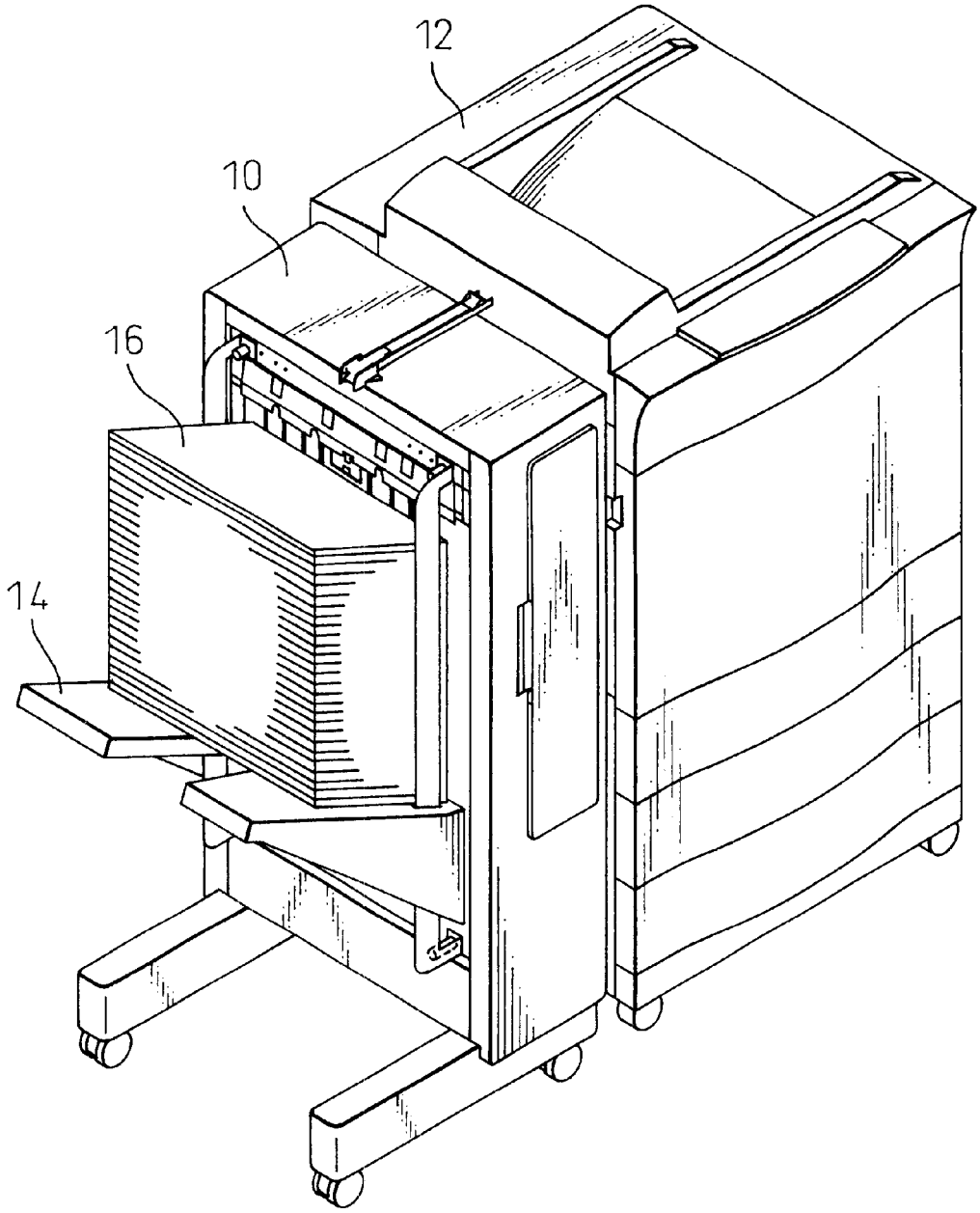
FIG. 1 is a perspective view showing a stacker, according to an embodiment of the present invention, together with a printer disposed adjacent thereto, in a state where a large number of papers are stacked on a tray.
Figure 2:
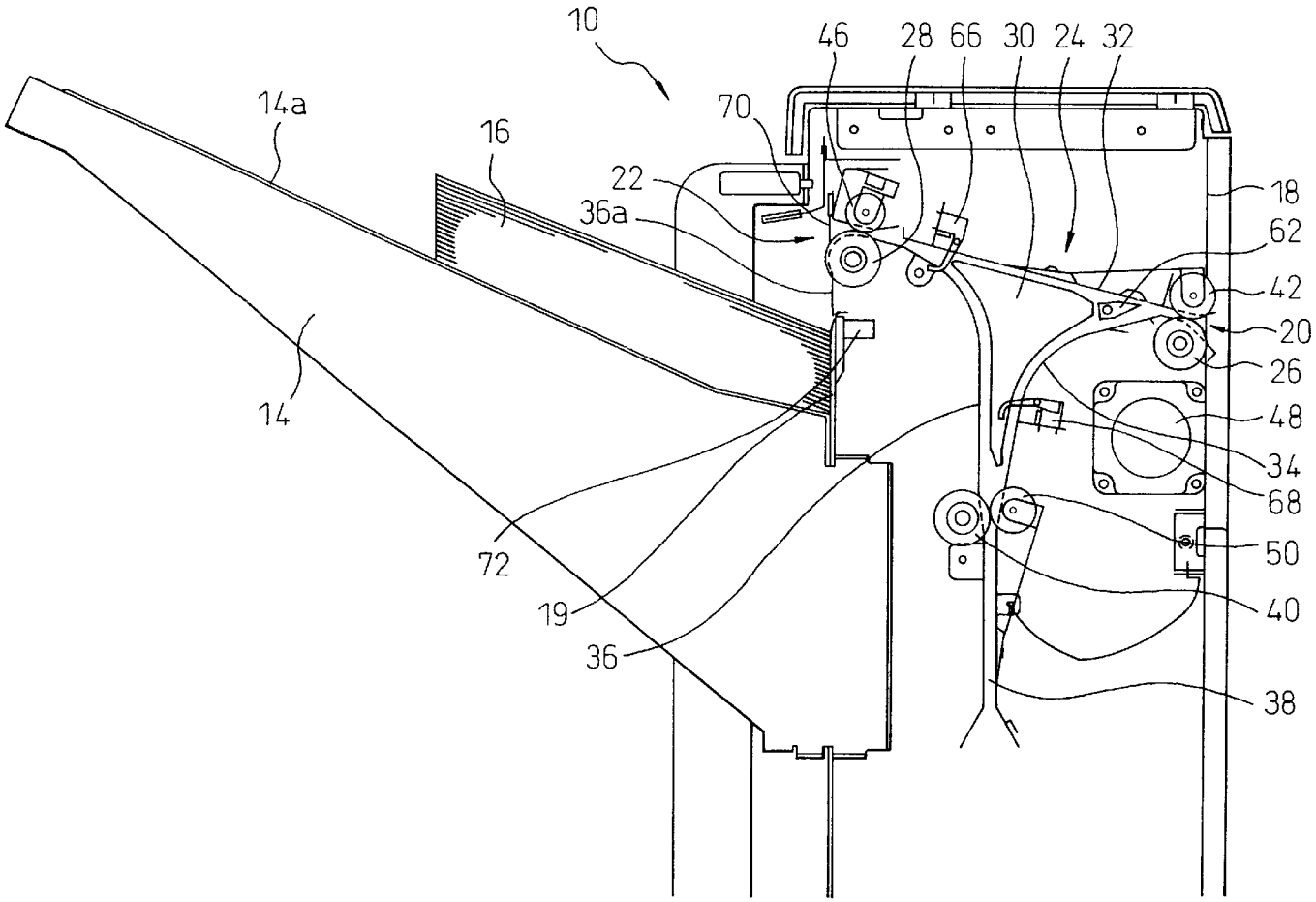
FIG. 2 is a vertical sectional view showing the main components of the stacker of FIG. 1, in a partially cut-out manner.
Figure 3:
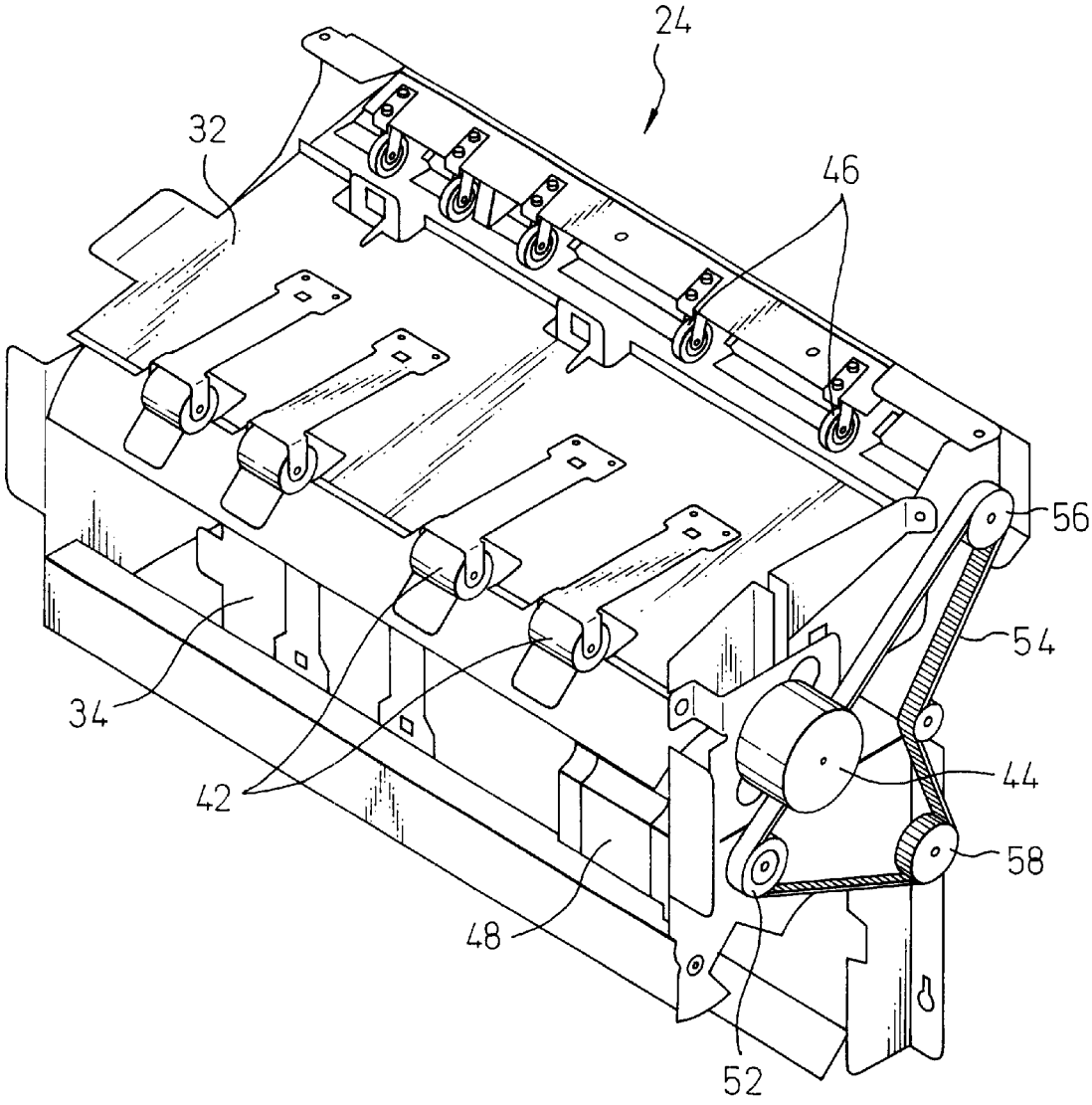
FIG. 3 is a perspective view of a paper transfer mechanism of the stacker of FIG. 1, as shown from a paper intake side.
Figure 4:
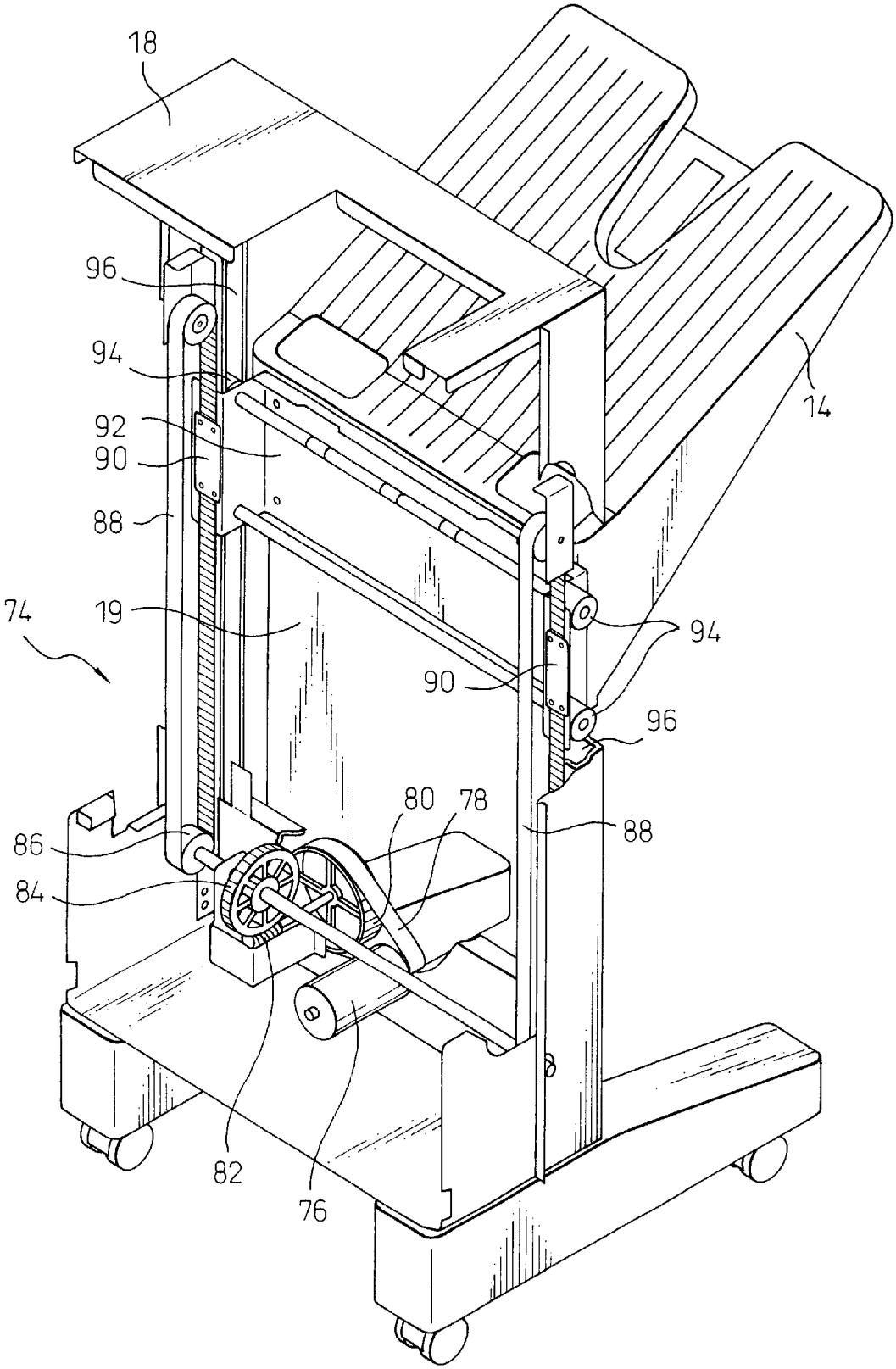
FIG. 4 is a perspective view of a tray drive mechanism of the stacker of FIG. 1, as shown from a paper intake side.

Referring to the drawings, FIG. 1 is a perspective view showing a stacker 10 according to an embodiment of the present invention and a printer 12 arranged adjacent to the stacker 10, FIG. 2 is a vertical sectional view showing the main components of the stacker 10 in a partially cut-out manner, FIG. 3 is a perspective view of a paper transfer mechanism of the stacker 10 as shown from a paper intake side, and FIG. 4 is a perspective view of a tray drive mechanism of the stacker 10 as shown from a paper intake side. The stacker 10 is so constructed as to be used in a side-by-side arrangement with a high-speed printer 12 capable of printing dozens of papers (e.g., 40 papers) per minute, and to be able to automatically stack several thousand printed printing papers or sheets (e.g., 3000 papers or more) on a tray.

Referring to FIG. 1, the papers printed at a speed of dozens of papers per minute by the printer 12 are illustrated to be discharged and stacked on the tray 14 after being taken into the stacker 10 to form a paper stack 16 including several thousand papers.

As shown in FIG. 2, the stacker 10 includes a housing 18 defining a stacker body and a tray 14 arranged on the back side of the housing 18 in an upward/downward movable manner. The tray 14 is provided with a paper support surface 14*a* inclined in such a manner that a proximal end nearer to the housing 18 is positioned lower than a distal end. The inclination angle of the paper support surface 14*a* is normally about 250 relative to a horizontal surface. The front side of the housing 18 is provided with an inlet port 20 for taking the paper delivered from the printer 12 into the stacker body, and the back side of the housing 18 is provided above the tray 14 with an outlet port 22 for discharging the taken-in paper out of the stacker body. The stacker 10 also includes a paper transfer mechanism 24 for transferring the paper from the inlet port 20 to the outlet port 22 and discharging it.

The paper transfer mechanism 24 includes a pickup roller 26 arranged at the inlet port 20 and an eject roller 28 arranged at the outlet port 22. Two paper carry routes are provided between the pickup roller 26 and the eject roller 28. One of the routes is a normal route through which the paper is carried in a face-up state, and is defined between an inner guide 30 fixedly arranged in the housing 18 and a straight guide 32 disposed opposite to the upper face of the inner guide 30 through a gap. The other is an inverting route through which the paper is inverted in the way of a carrying stage, and is defined between the inner guide 30 and a reverse guide 34 as well as an eject roller guide 36 both disposed opposite to the lower surface of the inner guide 30 through a gap. In the inverting route, the reverse guide 34 and the eject roller guide 36 extend opposite to each other under the inner guide 30 to define an inversion path 38 therebetween, and a reverse roller 40 is placed in the inversion path 38.

The eject roller guide 36 is provided in an integral manner with a portion constituting the latter half area of the inversion route in the housing 18 and a portion 36*a* extending out of the outlet port 22 to be exposed outside of the housing 18. The exposed portion 36*a* of the eject roller guide 36 is arranged adjacent to the upper end of the back plate 19 of the housing 18, and forms, in cooperation with the back plate 19, a lateral support surface for supporting the edges of the papers stacked on the tray 14.

The pickup roller 26 is a driving roller to be coupled with a driven roller 42, and is rotationally driven by a first drive motor 44 (FIG. 3). The eject roller 28 is a driving roller to be coupled with a driven roller 46, and is rotationally driven by a second drive motor 48 (FIG. 3). The reverse roller 40 is a driving roller to be coupled with a driven roller 50, and is rotationally driven by the common second driving motor 48 synchronously with the eject roller 28. As shown in FIG. 3, the output shaft of the second driving motor 48 is connected to the pulley 56 of the eject roller 28 and the pulley 58 of the reverse roller 40 through a drive pulley 52 and a drive belt 54. The first driving motor 44 and the second driving motor 48 are operated under the control of a control section 60 (see FIG. 5). The control section 60 is preferably structured from a control section of the printer 12 arranged side-by-side, but may alternatively be a control section provided exclusively for the stacker 10.

A separator 62 is placed downstream of the pickup rollers 26 in a paper feed direction, for distributing the paper to either one of the normal route and the inverting route. The separator 62 is driven to pivot by a separator drive section 64 (FIG. 5) operated under the control of the control section 60, and selectively closes the entrance of the normal route or the inverting route. An eject sensor 66 is arranged downstream of the inner guide 30 in the paper feed direction in association with both the normal and inverting routes. A reverse sensor 68 is arranged in the inverting route upstream of the reverse roller 40 in the paper feed direction. Further, a charge-eliminating brush 70 is placed in the outlet port 22.

The stacker 10 further includes an automatic lift mechanism for the tray 14 and, thus, is capable of stacking and holding a large number of papers automatically and accurately on the tray 14 in response to the automatic operation of the printer 12. The automatic lift mechanism includes a paper stack sensor 72 (FIG. 2) of a reflection type arranged in the housing 18 at a position under the outlet port 22 in a stacker back-side, i.e., at the upper end of the back plate 19, and a tray drive mechanism (FIG. 4) activated in accordance with a sensing signal of the paper stack sensor 72.

The tray drive mechanism 74 is composed of a tray drive motor 76, a reduction-pulley drive belt 78, a reduction pulley 80, a worm 82, a worm wheel 84, a pair of tray drive pulleys 86 and a pair of tray drive belts 88. Each of the tray drive belts 88 is fixedly connected to a tray base 92 through a belt attachment plate 90. The tray base 92 carries a pair of guide rollers 94 at the respective right and left ends thereof, and is directed in a vertical direction along the back plate 19 when the guide rollers 94 roll inside a pair of guide rails 96 extending in the vertical direction on the housing 18. The tray base 92 is secured to the proximal end of the tray 14 through a gap for receiving the back plate 19. The tray drive motor 76 is operated under the control of the above-described control section 60. Also, a limit switch 98 (FIG. 5) is arranged in proximity to the lowest position of the tray 14.

Figure 5:
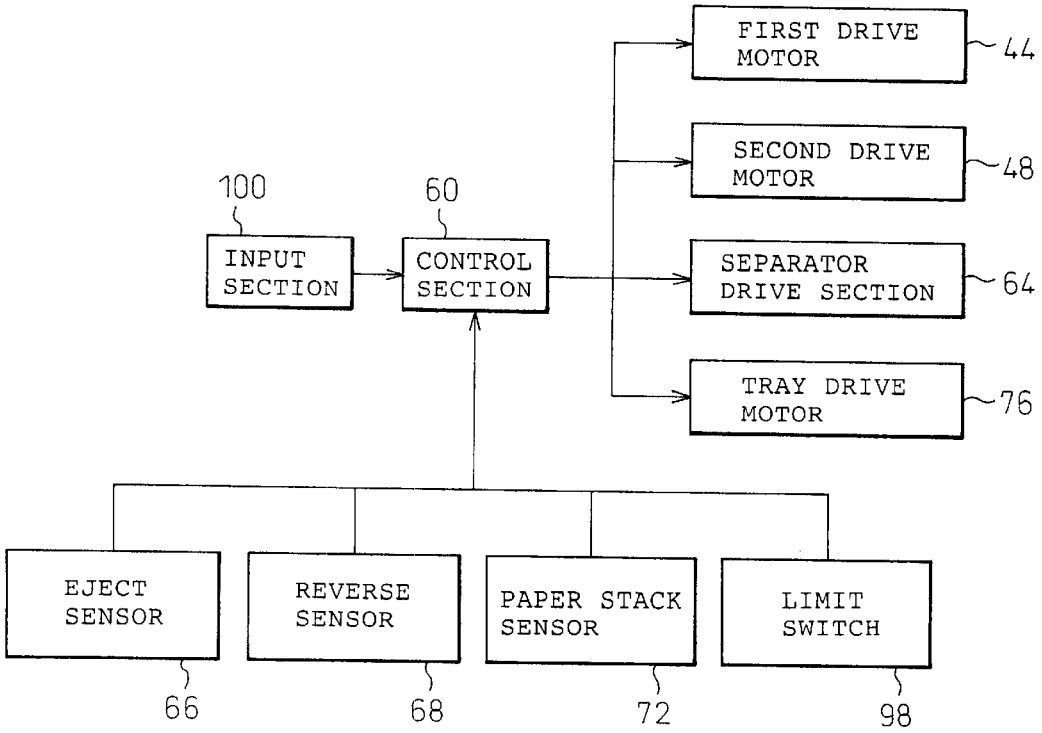
FIG. 5 is a block diagram showing a control mechanism for a paper transfer velocity in the stacker of FIG. 1.

The paper transferring and stacking operations of the stacker 10 having the above structure are described below. First, either one of the normal and inverting routes of the stacker 10 is selected, which is then entered into the control section 60 through an input section 100 (FIG. 5). With the activation of the stacker 10, the pickup roller 26, the eject roller 28 and the reverse roller 40 are respectively driven by the first and second drive motors 44, 48 to rotate at the same peripheral velocity (an intake speed $V_1$) as the paper delivery speed of the printer 12.

In the case where the normal route is selected, the separator 62 is actuated by the separator drive unit 64 to close the entrance for the inverting route. The printed paper delivered from the printer 12 (FIG. 1) is taken in through the inlet port 20 of the stacker 10 in a face-up state, and is transferred between the inner guide 30 and the straight guide 32 at the intake speed $V_1$ by the pickup roller 26. When the leading end of the paper reaches the eject sensor 66, the eject sensor 66 outputs an on-signal to the control section 60, so that the second drive motor 48 drives to rotate the eject roller 28 and the reverse roller 40 at a carrying speed $V_2$ higher than the speed of the pickup roller 26.

When the paper is further transferred, the eject roller 28 catches the paper and forwards it to the outlet port 22 at the carrying speed $V_2$. The paper caught by the eject roller 28 is still engaged with the pickup roller 26, but is fed at the peripheral velocity of the eject roller 28 free of the load of the pickup roller 26, due to the operation of a one-way clutch (not shown) built into the pickup roller 26. As the paper passes through the outlet port 22 outward, the paper comes into contact with the charge-eliminating brush 70 to be charge-eliminated.

At the instant when the frontward portion of the paper has been exposed by a predetermined length out of the outlet port 22, the paper has passed the eject sensor 66 which in turn outputs an off-signal to the control section 60. As a result, the second drive motor 48 drives to rotate the eject roller 28 at a discharge speed $V_3$ higher than the carrying speed $V_2$.

The eject roller 28 discharges the paper from the outlet port 22 above the tray 14 at the discharge speed $V_3$ to make it fly. The paper that has first fallen on the tray 14 slides down on the support surface 14*a* by its own weight, and bumps against the back plate 19 of the housing 18 to stop at a predetermined position. After that, the eject roller is driven at the intake speed $V_1$ and waits for the next paper.

The next paper is discharged from the outlet port 22 above the tray 14 after being subjected to the similar transferring process, falls and slides down on the first paper, and also bumps against the back plate 19 of the housing 18 to stop at a predetermined position. By repeating the above process, a large number of papers are stacked in the face-up state on the tray 14 with the edges thereof aligned to one another.

When the paper stack 16 (FIG. 2) piled on the tray 14 closes the front side of the paper stack sensor 72, the paper stack sensor 72 outputs a sensing signal, and the tray drive motor 76 is actuated under the control of the control section 60 to move the tray 14 downward. Thus, the tray 14 moves downward according as the number of stacked papers increases, while the position of the top surface of the paper stack 16 on the tray 14 is held at a substantially constant height in the vicinity of the paper stack sensor 72. When the tray 14 reaches a most lowered position with several thousand papers (e.g., 3000 or more papers) being stacked thereon, the limit switch 98 detects it and outputs a stop signal to the control section 60. This stop signal is simultaneously output to the control section (not shown) of the printer 12. As a result, the printer 12 and the stacker 10 come to a stop, and thereby printing and paper stacking operations are completed.

In the case where the inverting route is selected, the separator 62 is actuated by the separator drive unit 64 to close the entrance for the normal route. The printed paper delivered from the printer 12 is taken in through the inlet port 20 of the stacker 10 in a face-up state, and is transferred between the inner guide 30 and the reverse guide 34 at the intake speed $V_1$ by the pickup roller 26. When the leading end of the paper reaches the reverse sensor 68, the reverse sensor 68 outputs an on-signal to the control section 60, so that the second drive motor 48 drives to rotate the eject roller 28 and the reverse roller 40 at the carrying speed $V_2$ higher than the speed of the pickup roller 26. When the paper is further transferred, the reverse roller 40 catches the paper and forwards the paper to the inversion path 38 at the carrying speed $V_2$ due to the operation of the one-way clutch of the pickup roller 26.

When the paper has passed the reverse sensor 68 and the reverse sensor 68 outputs an off-signal to the control section 60, the paper is further fed by a predetermined distance, and thereafter the second drive motor 48 drives to rotate the reverse roller 40 in a reverse direction at the carrying speed $V_2$. As a result, the paper moves in the opposite direction along the inversion path 38 and is transferred between the inner guide 30 and the eject roller guide 36 at the carrying speed $V_2$. Even when the paper reaches the eject sensor 66, the eject roller 28 continues to rotate at the carrying speed $V_2$, and thereafter catches the paper to forward it to the outlet port 22 at the carrying speed $V_2$. At the instant when the frontward portion of the paper has been exposed to a predetermined length out of the outlet port 22, the paper has passed the eject sensor 66 which in turn outputs an off-signal to the control section 60. As a result, the eject roller 28 rotates at the discharge speed $V_3$ higher than the carrying speed $V_2$, in the same way as in the normal route, and discharges the paper from the outlet port 22 above the tray 14 to make it fly. In this manner, the paper is stacked on the tray 14 in a face-down state, inverted from the face-up state, upon being taken in.

The stacker 10 according to the invention is characterized in that a paper transfer velocity changes in stages during a paper transferring process and is controlled so as to obtain the relationship: intake speed $V_1$<carrying speed $V_2 \leqq$discharge speed $V_3$, as described above. Further, the carrying speed $V_2$ is limited to such a range that, in the case where a concavely curled paper taken in from the printer is carried in the face-up state through the normal route and is discharged above the tray 11, the leading end of the paper is not further curled upward under the inconvenient lifting force, even when the paper recovers a concave-curl shape as it passes through the outlet port 22. As a result, even in the case of a face-up carrying mode along the normal route, the paper is prevented from stalling after being discharged and can fly as expected. Thus, the paper falling on the tray is prevented from leaning against the back plate 19 of the housing 18 or the exposed portion 36a of the eject roller guide 36.

As already described, the time period concerned with the flying behavior of the paper consists of the carry time $T_2$ and the discharge time $T_3$ (see FIG. 8), and particularly the carrying speed $V_2$ for the carry time $T_2$ significantly affects the flying mode of the paper. In view of this, an experiment was carried out to clarify the relationship between the carrying speed $V_2$ (mm/s) of the eject roller 28 and the flying distance (mm) of the paper in the case where the concavely curled paper is carried along the normal route and is discharged. The experiment was repeated a plurality of times for each of several different carrying speeds $V_2$ by using A4-size printing papers, and a maximum value, a minimum value and an average value of flying distances were determined for each speed. In the experiment, the intake speed $V_1$ was maintained at 180 mm/s and the discharge speed $V_3$ was maintained at 400 mm/s. Also, in order to cancel the resistance of the charge-eliminating brush 70 against a paper discharging force, the flying distance of the paper was measured in the condition where the charge of the paper was eliminated by using a voltage impress type charge eliminator. The result of the experiment is shown in FIG. 6.

Figure 6:
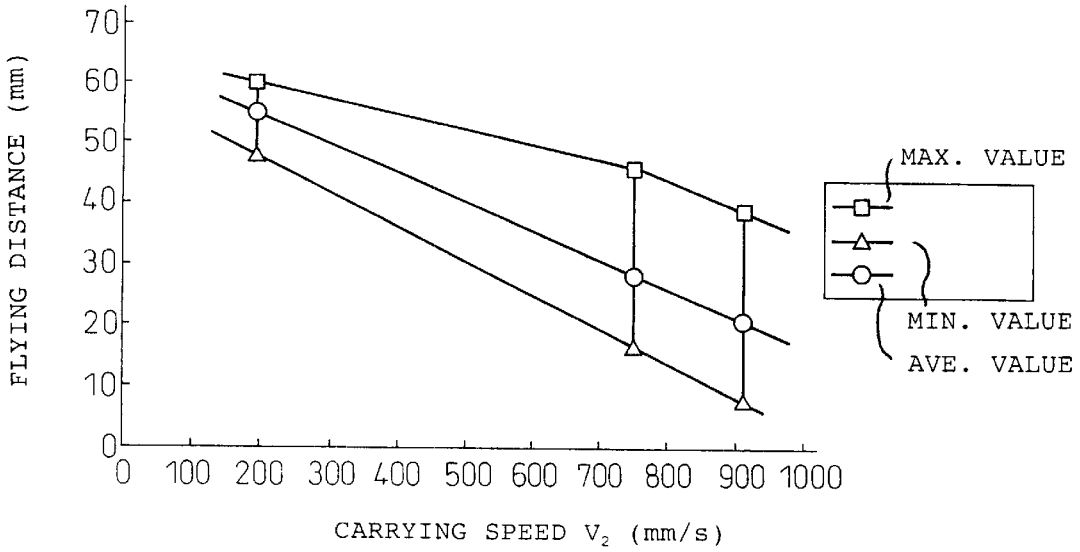
FIG. 6 is a diagram showing a relationship between a carrying speed of an eject roller and a flying distance of a paper in the stacker of FIG. 1.

As clearly shown in FIG. 6, the higher the carrying speed $V_2$ of the eject roller 28, the shorter the flying distance. This is because that, as already described, when the paper is discharged from the outlet port 22, the higher the carrying speed $V_2$, the more the leading end of the paper easily receives a disadvantageous lifting force, and consequently, it is facilitated that the paper stalls and falls at the instant when the tail end of the paper leaves the eject roller 28. It is also empirically known that the paper flying distance of at least 30 mm makes it possible to accurately stack several thousand papers on the tray 14 regardless of whether the paper with the concave curl is discharged in the face-up state or the face-down state. Thus, by specifying the range for realizing the flying distance of 30 mm or more with a straight line joining the minimum values in FIG. 6, it will be understood that a preferred carrying speed $V_2$ is about 500 mm/s or less.

Further, in order to specify a preferred discharge speed $V_3$, an experiment was carried out to clarify the relationship between the discharge speed $V_3$ (mm/s) of the eject roller 28 and paper alignment properties on the tray 14 in the case where concavely curled paper is carried along the normal route and is discharged. The paper alignment properties were evaluated by using a known paper-distribution function installed in the stacker 10 to divide papers into a plurality of ten-paper stacks and to pile these ten-paper stacks while slightly displacing them leftward and rightward relative to each other on the tray 14, and by measuring maximum values (mm) of irregularities of papers relative to a target position thereof in the respective ten-paper stacks. In the experiment, in order to minimize the influence of the carrying speed $V_2$ of the eject roller 28 on the flying mode, the carrying speed $V_2$ was maintained at 180 mm/s, identical to the intake speed $V_1$. A4-size printing papers were used. The result of the experiment is shown in FIG. 7.

Figure 7:
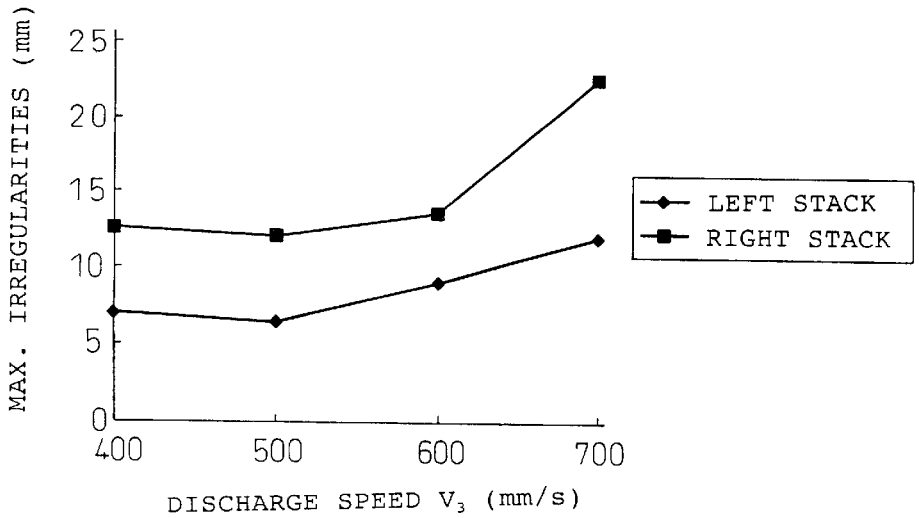
FIG. 7 is a diagram showing a relationship between a discharge speed of the eject roller and paper alignment properties in the stacker of FIG. 1.

As clearly shown in FIG. 7, when the discharge speed $V_3$ of the eject roller 28 exceeds 500 mm/s, the paper irregularities increase for both the right and left paper stacks. Thus, it will be understood that a preferred discharge speed $V_3$ is not more than about 500 mm/s.

In view of the above-described results of experiments, in the case where the concavely curled papers are carried in the face-up state through the normal route and discharged above the tray 14, it is effective that the carrying speed $V_2$ of the eject roller 28 is controlled to not more than 500 mm/s so as to prevent the paper from being stalled upon being discharged and that the discharge speed $V_3$ is also controlled to 500 mm/s or less so as to maintain a high degree of paper alignment, in order to stack several thousand papers (e.g., 3000 papers or more) with good paper-alignment but without leaning against the back plate 19 of the housing 18 or the exposed portion 36*a* of the eject roller 36. Further, because the time required for transferring the paper in the stacker 10 is increased as compared with a conventional structure as a result of controlling the carrying speed $V_2$, it is desirable to set the discharge speed $V_3$ higher than the carrying speed $V_2$ so as to shorten a paper transferring time as far as possible.

Figure 8:
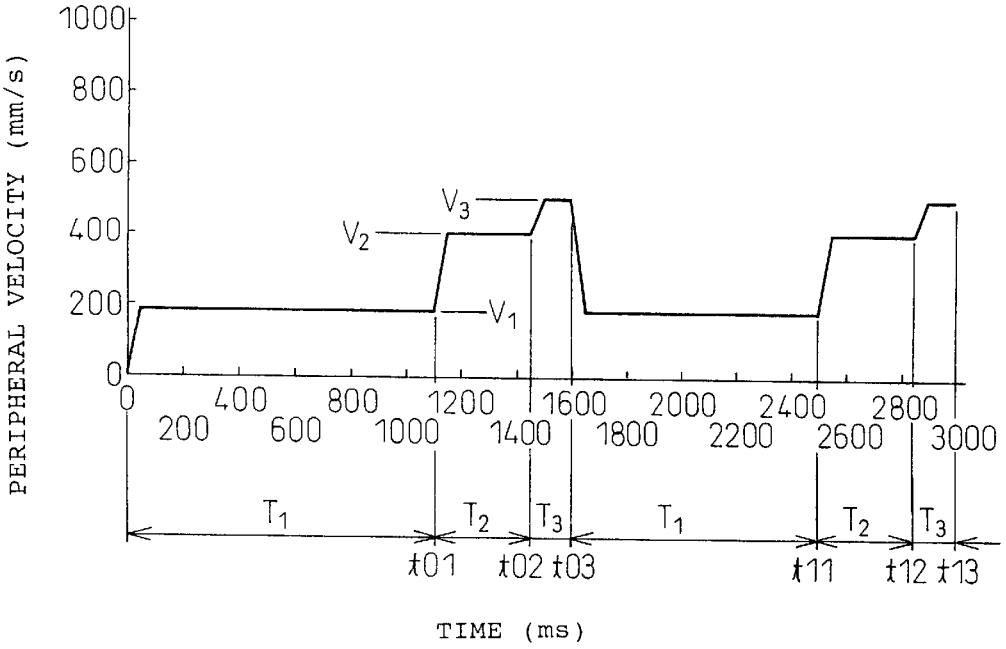
FIG. 8 is a velocity diagram showing the peripheral velocity of the eject roller of the stacker of FIG. 1.

From the above viewpoints, a preferred range of a paper transfer velocity change from paper-intake to paper-discharge in the stacker 10 is expressed by the peripheral velocity of the eject roller 28, such that the intake speed $V_1$ is equal to the paper delivery speed of the printer, the carrying speed $V_2$ satisfies the relation of $V_1<V_2\leqq 500$ mm/s and the discharge speed $V_3$ satisfies the relation of $V_2\leqq V_3\leqq 500$ mm/s. An example of a preferred paper transfer velocity is shown in FIG. 8 as a velocity diagram of the eject roller 28. In FIG. 8, a horizontal axis represents a time (ms) and a vertical axis represents the peripheral velocity (mm/s) of the eject roller 28. As illustrated, a preferred peripheral velocity of the eject roller 28 is expressed as, e.g., the intake speed $V_1$=180 mm/s for the time $T_1$ of taking the paper into the stacker body, the carrying speed $V_2$=400 mm/s for the time $T_2$ of carrying the paper in the stacker body, and the discharge speed $V_3$=500 mm/s for the time $T_3$ of discharging the paper above the tray. The eject roller 28 is provided with a drive source independent of the pickup roller 26, and thus is not necessarily decelerated to the intake speed $V_1$ during the intake time $T_1$ but may be controlled in two stages of the carrying speed $V_2$ and the discharge speed $V_3$.

In the actual paper stacking operation by the stacker 10, the expensive voltage impress type charge eliminator is not used, but a charge-eliminating brush 70 is used for eliminating the charge of the paper. In this case, a slight amount of charge remains on the paper, as already described. On the other hand, if the concavely curled paper is discharged in a face-up state and has flown over a sufficient distance, the paper slides down on the tray 14 or on a previously formed paper stack and bumps against the back plate 19 of the housing 18, while the two raised corners P1, P2 (see FIG. 9) of the edge of the paper nearer to the back plate 19 come into contact with the back plate 19 earlier than the center portion of the same edge. In this situation, even when the concavely curled paper is discharged in the face-up state under the above-described speed control and has flown a sufficient distance, the paper leans against the back plate 19 and is adsorbed thereto locally at the two corners P1, P2 due to the residual static electricity upon bumping into the back plate 19.

Figure 9:
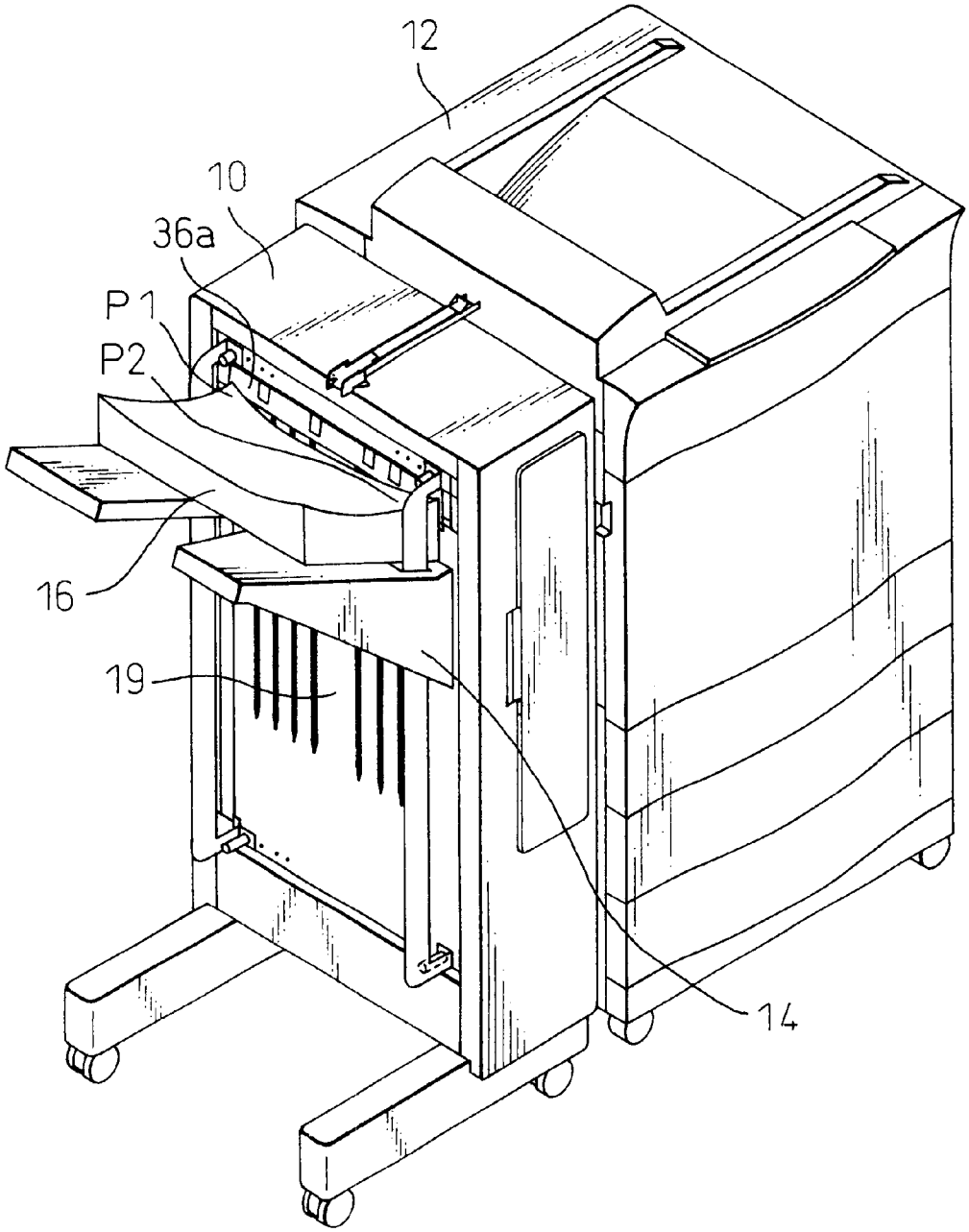
FIG. 9 is a perspective view illustrating a local leaning condition of the paper in the stacker of FIG. 1.

This phenomenon is especially liable to occur when the paper bumps against the exposed portion 36*a* of the eject roller guide 36 located at the upper end of the back plate 19. As already described, the exposed portion 36*a* of the eject roller guide 36 also acts as the exterior part of the stacker body, and thus the eject roller guide 7 is formed from a surface-treated steel plate having a very thin oxide film with a thickness on the order of $\mu$m, so that the paper is easily adsorbed electrostatically. Also, the leaning phenomenon is liable to occur in the case where the paper has a concave-curl shape of which the four corners are raised by about 20 mm to 30 mm. If the large number of papers discharged under the above velocity control and stacked on the tray 14 contain the papers, even a few paper, adsorbed to the exposed portion 36*a* due to the leaning phenomenon, the leaning phenomenon is gradually enhanced while the papers are continued stacked, whereby the paper stack 16 is no longer formed normally. FIG. 9 shows the condition where the paper stack 16 results in a loading failure due to the above-described local leaning phenomenon of two corners of the papers.

Figure 10:
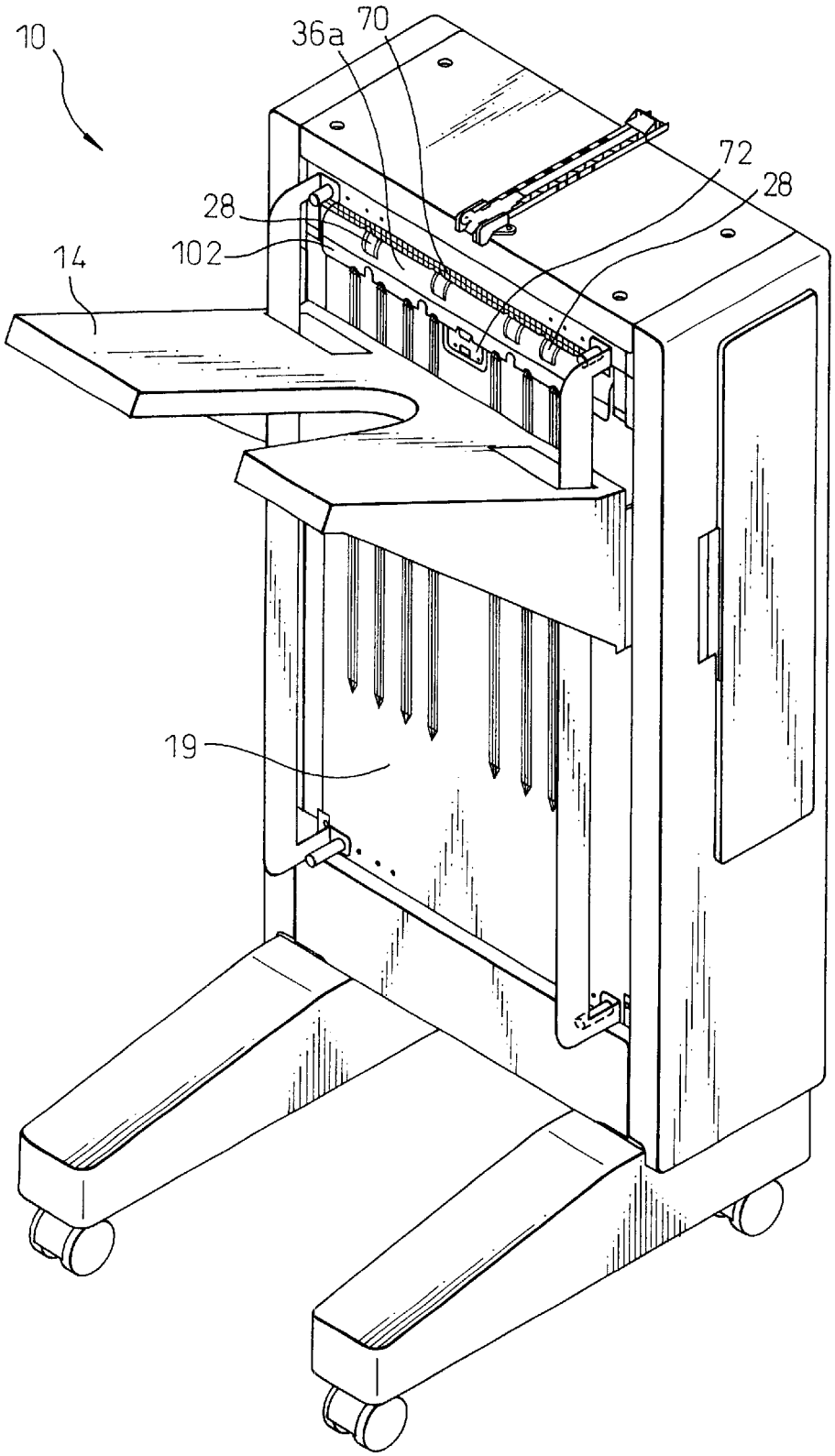
FIG. 10 is a perspective view of a stacker according to another embodiment of the present invention.
Figure 11:
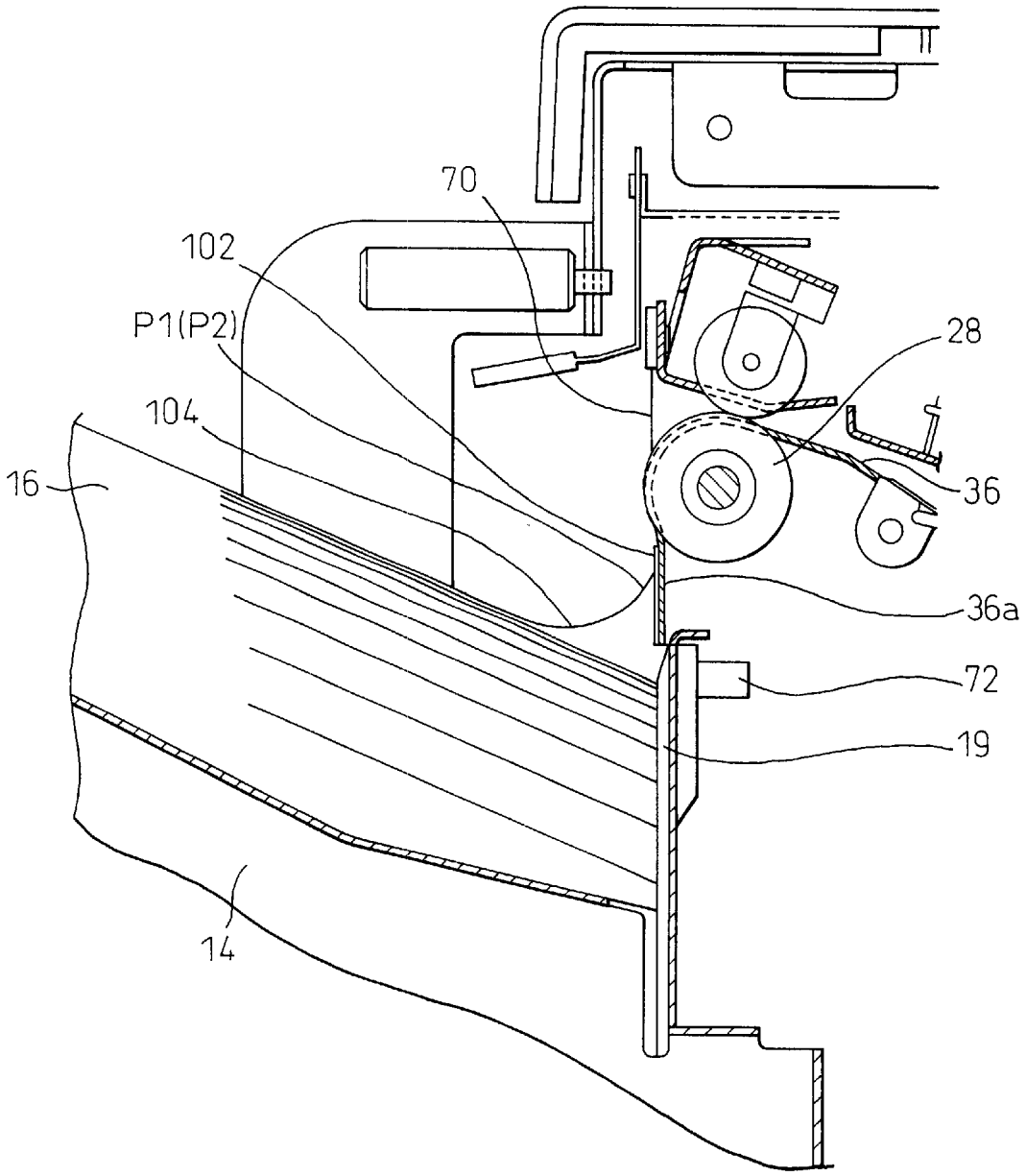
FIG. 11 is a vertical sectional view showing the main components of the stacker of FIG. 10, in a partially cut-out manner.

In order to solve the above problem, the stacker 10 may include an insulating thin plate 102 attached to the exposed portion 36*a* of the eject roller guide 36, as shown in FIGS. 10 and 11. The thin plate 102 is made of a resinous material, such as polyester, and has a thickness of about 0.1 mm to 0.2 mm. As a result, the raised corner P1 (P2) of the uppermost paper 104 of the paper stack 16 piled on the tray 14 and the exposed portion 36*a* of the eject roller guide 36 are isolated from each other.

When the corner P1 (P2) of the paper 104 is isolated from the exposed portion 36*a* of the eject roller guide 36 through the insulating material, the electrostatic adsorbing force occurring between the paper 104 and the eject roller guide 36 considerably decreases because it occurs in inverse proportion to the square of the distance. Therefore, when the tray 14 moves downward from the position of FIG. 11, the paper 104 lowers along the back plate 19 together with the paper stack 16 without being adsorbed to the eject roller guide 36. As a result, even when the papers are continuously stacked, the leaning phenomenon is prevented from being enhanced, and furthermore, the concave-curl shape is gradually corrected, by the weight of the paper, to a flat shape, which results in the normal formation of the paper stack 16, of several thousand papers, without any loading failure.

Figure 12:
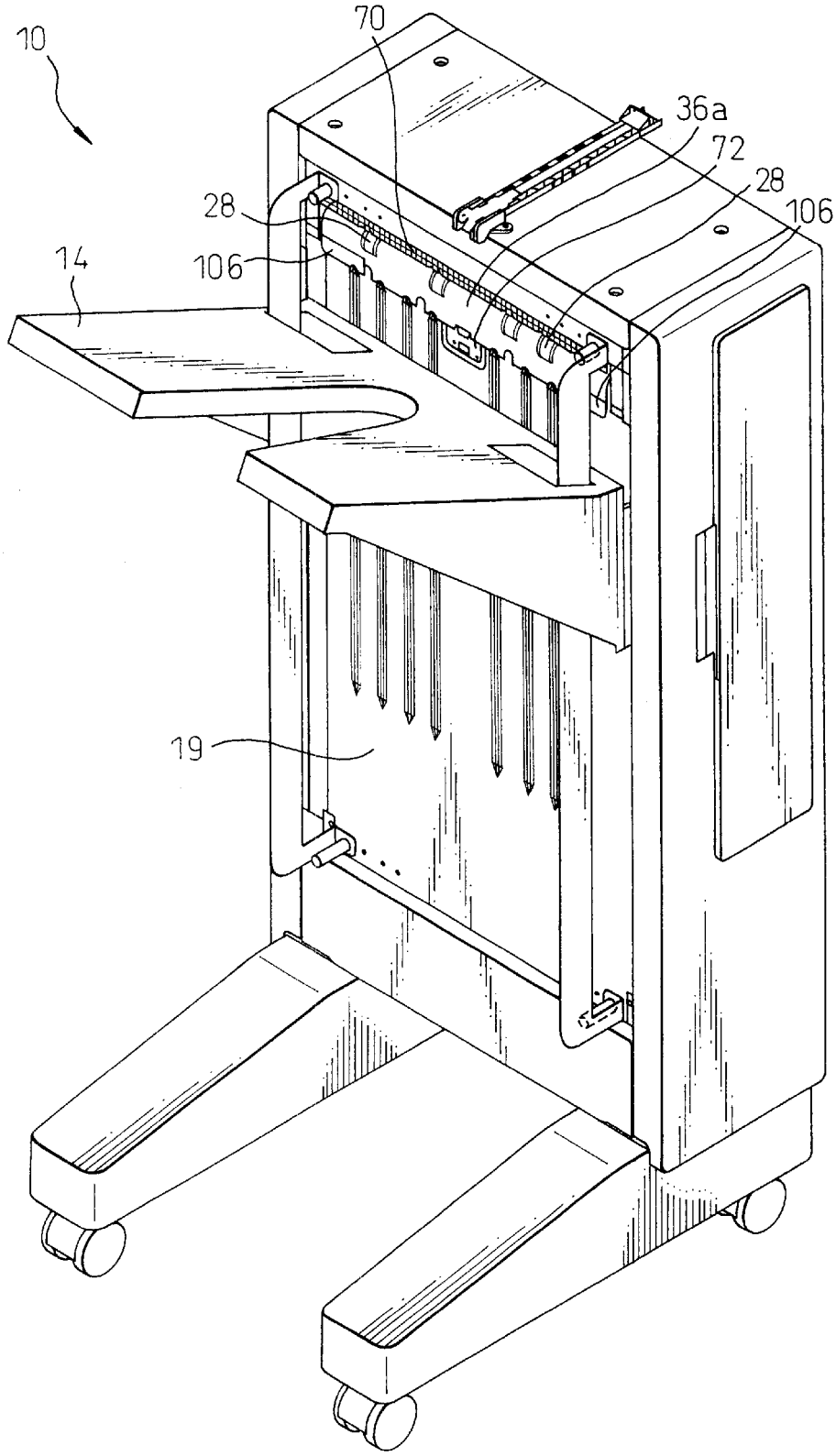
FIG. 12 is a perspective view of the stacker according to a modification.
Figure 13:
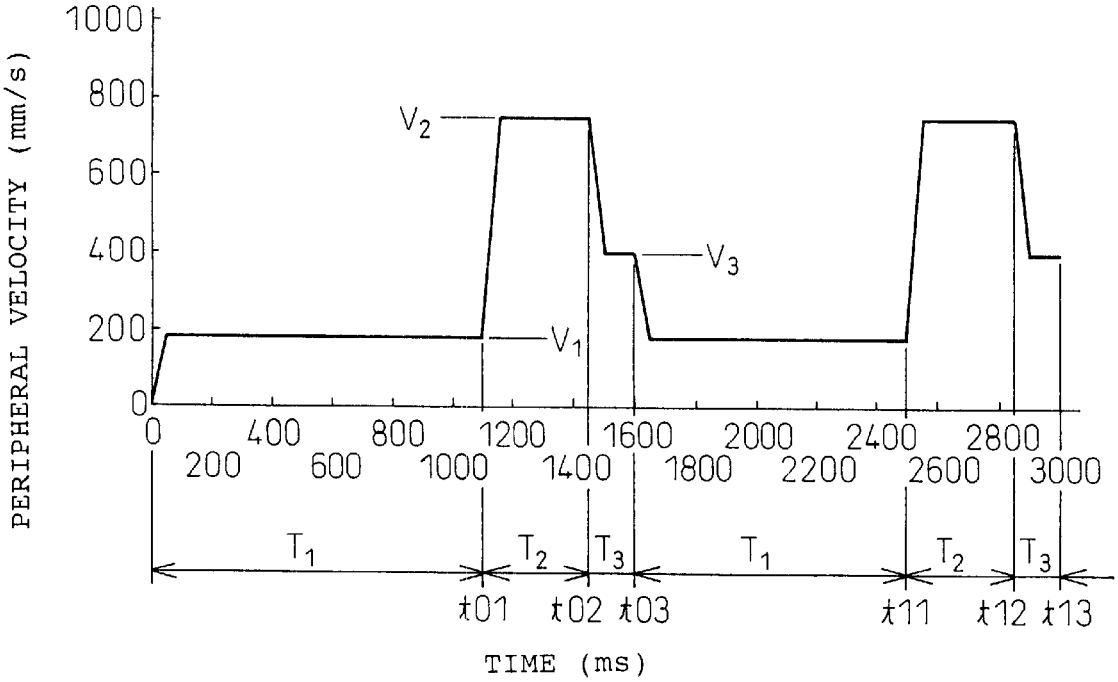
Fig.13 PRIOR ART
FIG. 13 is a velocity diagram showing the peripheral velocity of an eject roller in a conventional stacker.
Figure 14:
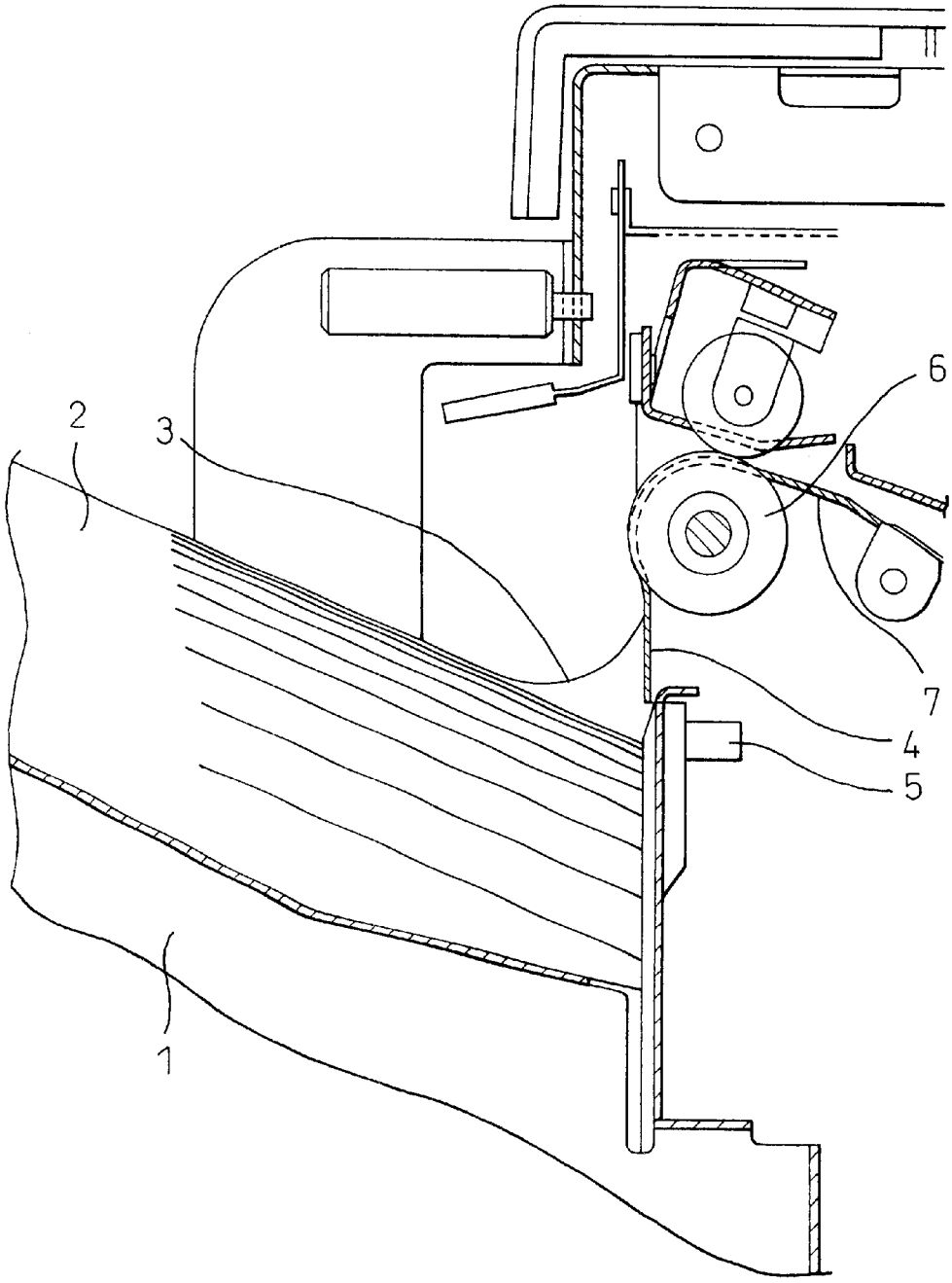
Fig. 14 PRIOR ART
FIG. 14 is a vertical sectional view illustrating a leaning condition of a paper in the conventional stacker.

In the illustrated embodiment, the thin plate 102 has such a dimension as to extend along the entire length of the edge of the paper stacked on the tray 14, and is fixedly attached by, e.g., an adhesive to the exposed portion 36*a* of the eject roller guide 36. As shown in FIG. 12, however, it is advantageous in view of a cost performance to fix a pair of comparatively small thin plates 106 only at locations where the corners P1, P2 of the paper stacked on the tray 14 may come into contact with the exposed portion 36*a* of the eject roller guide 36. Also, the eject roller guide 36 may be entirely made of a resinous material, but in consideration of the cost for an injection-molded resinous article, only a part of the eject roller guide 36 (a part with which the paper corners P1, P2 may come into contact) may be made of a resinous material, or the eject roller guide 36 may be entirely coated by a resinous film. Further, various insulating materials other than the resinous material, such as a cardboard, an wood or a glass, may of course be used as the thin plate. If the eject roller guide 36 is not provided with the exposed portion 36*a*, the insulating thin plate can be secured at a desired position on the back plate 19 of the housing 18.

Although the preferred embodiments of the present invention have been described above, the present invention is not confined to these embodiments but can be modified in various ways without departing from the spirit and scope of the invention.

INDUSTRIAL APPLICABILITY

The present invention provides a stacker which, even when a paper with a concave-curl shape is taken therein from a printer, is carried in a face-up state and is discharged above a tray, can prevent the paper from leaning against the back plate of a stacker body, and a method of controlling such a stacker. According to the present invention, the large number of papers, as many as several thousand papers, can be reliably and automatically stacked on the tray without causing any loading failure of papers, during the automatic operation of a high-speed printer.

What is claimed is:

1. A stacker comprising:

a housing provided with an inlet port and an outlet port:

a tray arranged beneath said outlet port of said housing in an upward/downward moveable manner;

a transfer mechanism for transferring printed sheets from said inlet port to said outlet port and discharging the sheets above said tray through said outlet port; and a control mechanism for controlling a sheet transfer velocity of said transfer mechanism in three stages including an intake speed at which the printed sheets are taken in though said inlet port, a carrying speed at which the sheets are carried from said inlet port to said outlet port and a discharge speed at which the sheets are discharged from said outlet port above said tray, said carrying speed being higher than said intake speed and said discharge speed being not lower than said carrying speed;

wherein said transfer mechanism includes a pickup roller arranged at said inlet port, a first drive source for said pickup roller, an eject roller arranged at said outlet port and a second drive source for said eject roller, and wherein said control mechanism controls said second drive source in the three stages of said intake speed, said carrying speed and said discharge speed.

2. A stacker as set forth in claim 1, wherein said carrying speed is not more than 500 mm/s.

3. A stacker as set forth in claim 1, wherein said discharge speed is not more than 500 mm/s.

4. A stacker as set forth in claim 1, wherein said tray is provided with an inclined support surface of which a proximal end, nearer to said housing, is positioned lower than a distal end.

5. A stacker as set forth in claim 1, further comprising an automatic lift mechanism for moving said tray downward as the number of printed sheets stacked on said tray increases.

6. A stacker as set forth in claim 1, further comprising an insulating member arranged on a part of a lateral support surface of said housing located below said outlet port.

7. A stacker as set forth in claim 6, wherein said insulating member is formed from a thin plate secured to said lateral support surface.

8. A stacker comprising:

a housing provided with an inlet port and an outlet port;

a tray arranged beneath said outlet port of said housing in an upward/downward movable manner;

a transfer mechanism for transferring printed sheets from said inlet port to said outlet port and discharging the sheets above said tray through said outlet port; and an insulating member separate from said tray and arranged on a part of a lateral support surface of said housing located below said outlet port.

* * * * *

UNITED STATES PATENT AND TRADEMARK OFFICE

CERTIFICATE OF CORRECTION

PATENT NO. : 6,378,864 B1
DATED : April 30, 2002
INVENTOR(S) : Tsutomu Iesaka

It is certified that error appears in the above-identified patent and that said Letters Patent is hereby corrected as shown below:

Title page,
Item [73], Assignee, "Citizen Watch, Co., LTD," should read -- Citizen Watch Co., LTD, --.
Item [87], PCT publication No., "WO99/23367" should read -- WO00/23367 --.
Item [30], Foreign Application Priority Data, "October 27, 1998" should read -- October 22, 1998 --.

Column 12,
Line 60, "port:" should read -- port; --.

Column 13,
Line 2, "though" should read -- through --.

Signed and Sealed this

Twenty-eighth Day of January, 2003

JAMES E. ROGAN
*Director of the United States Patent and Trademark Office*